US010017290B2

(12) United States Patent
Faulkner et al.

(10) Patent No.: US 10,017,290 B2
(45) Date of Patent: Jul. 10, 2018

(54) CARTON WITH RECLOSABLE LOCK

(71) Applicant: Graphic Packaging International, LLC, Atlanta, GA (US)

(72) Inventors: William Faulkner, Marietta, GA (US); Aaron Lee Bates, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/372,481

(22) Filed: Dec. 8, 2016

(65) Prior Publication Data

US 2017/0158372 A1 Jun. 8, 2017

Related U.S. Application Data

(60) Provisional application No. 62/264,530, filed on Dec. 8, 2015.

(51) Int. Cl.
*B65D 5/20* (2006.01)
*B65D 5/24* (2006.01)

(52) U.S. Cl.
CPC ..... *B65D 5/2057* (2013.01); *B65D 5/2047* (2013.01); *B65D 5/244* (2013.01)

(58) Field of Classification Search
CPC .... B65D 5/2057; B65D 5/2047; B65D 5/244; B65D 5/241
USPC ..... 229/128, 155, 186, 117.14, 103.3, 114, 229/149, 125.28, 126, 157, 158, 188, 229/198.2
See application file for complete search history.

(56) References Cited

U.S. PATENT DOCUMENTS 396,570 A * 1/1889 Hotchkiss ..... B65D 5/4287 229/114
1,373,365 A 3/1921 Smouse
2,330,521 A * 9/1943 Scheide ..... B65D 5/2057 206/1.5

(Continued)

FOREIGN PATENT DOCUMENTS

CA 1079240 6/1980
JP 2004-123101 4/2004

(Continued)

OTHER PUBLICATIONS

International Search Report and Written Opinion for PCT/US2016/065494 dated Mar. 24, 2017.

*Primary Examiner* — Christopher Demeree
(74) *Attorney, Agent, or Firm* — Womble Bond Dickinson (US) LLP

(57) ABSTRACT

A carton for holding at least one food product is disclosed, and includes a plurality of panels that extends at least partially around an interior of the carton, a first side flap, and a second side flap. The plurality of panels includes a bottom panel, a first side panel foldably connected to the bottom panel, a second side panel foldably connected to the bottom panel, and at least one end panel foldably connected to the bottom panel. The first side flap is foldably connected to the first side panel and includes a first tab and a second tab. The second side flap is foldably connected to the second side panel and includes a first locking feature and a second locking feature. The first tab is engaged with the first locking feature and the second tab is engaged with the second locking feature to form a reclosable lock of the carton.

47 Claims, 6 Drawing Sheets

(56) References Cited

U.S. PATENT DOCUMENTS

| | | | | | |
|---|---|---|---|---|---|
| 2,341,762 | A * | 2/1944 | Conklin | B65D 5/2047 | 229/117.14 |
| 2,355,729 | A * | 8/1944 | Inman | B65D 5/64 | 229/117.14 |
| 2,355,730 | A * | 8/1944 | Inman | B65D 5/46128 | 229/114 |
| 3,027,063 | A * | 3/1962 | Zastrow | B65D 5/2061 | 229/103.3 |
| 3,324,999 | A | 6/1967 | Farquhar | | |
| 3,355,089 | A | 11/1967 | Champlin | | |
| 3,447,735 | A | 6/1969 | Whitney | | |
| 3,886,901 | A | 6/1975 | Zeitter | | |
| 4,068,795 | A | 1/1978 | Forster | | |
| 4,328,923 | A | 5/1982 | Graser | | |
| 4,340,169 | A | 7/1982 | Webinger | | |
| 4,449,633 | A | 5/1984 | Johnson et al. | | |
| 5,016,813 | A | 5/1991 | Simons | | |
| 5,094,359 | A | 3/1992 | DeMars et al. | | |
| 5,125,565 | A | 6/1992 | Rogers | | |
| 5,170,934 | A | 12/1992 | Lemoine | | |
| 5,292,058 | A | 3/1994 | Zoss et al. | | |
| 5,307,986 | A | 5/1994 | Schuster | | |
| 5,411,204 | A | 5/1995 | Demay | | |
| 5,522,538 | A * | 6/1996 | Gray | B65D 5/2047 | 229/112 |
| 7,021,525 | B2 | 4/2006 | Jouppi et al. | | |
| 9,169,037 | B2 | 10/2015 | Pinkstone | | |
| 2004/0182916 | A1 | 9/2004 | Roseth | | |
| 2005/0279815 | A1 | 12/2005 | Fogle et al. | | |
| 2006/0255105 | A1 | 11/2006 | Sweet | | |
| 2007/0095881 | A1 | 5/2007 | Manaige | | |
| 2009/0039144 | A1 | 2/2009 | Hooi et al. | | |
| 2014/0263600 | A1 | 9/2014 | Valencia | | |

FOREIGN PATENT DOCUMENTS

| | | |
|---|---|---|
| JP | 2009-073536 | 4/2009 |
| WO | WO 89/10308 | 11/1989 |

* cited by examiner

CARTON WITH RECLOSABLE LOCK

CROSS-REFERENCE TO RELATED APPLICATION

The present application claims the benefit of U.S. Provisional Patent Application No. 62/264,530, filed on Dec. 8, 2015.

INCORPORATION BY REFERENCE

The disclosure of U.S. Patent Application No. 62/264,530, filed on Dec. 8, 2015, is hereby incorporated by reference for all purposes as if presented herein in its entirety.

BACKGROUND OF THE DISCLOSURE

The present disclosure generally relates to packages for holding and displaying food products. More specifically, the present disclosure relates to cartons having locking features.

SUMMARY OF THE DISCLOSURE

According to one aspect, the disclosure is generally directed to a carton for holding at least one food product. The carton comprising a plurality of panels that extends at least partially around an interior of the carton. The plurality of panels comprising a bottom panel, a first side panel foldably connected to the bottom panel, a second side panel foldably connected to the bottom panel, and at least one end panel foldably connected to the bottom panel. A plurality of flaps respectively foldably connected to the plurality of panels for closing the top of the carton. The plurality of flaps comprises a first side flap foldably connected to the first side panel and a second side flap foldably connected to the second side panel. A reclosable lock for securing at least the first side flap and the second side flap to close the top of the carton. The reclosable lock comprises a first locking feature and a second locking feature in the first side flap and a first locking tab and a second locking tab in the second side flap. The first locking tab being for engagement with the first locking feature and the second locking tab being for engagement with the second locking feature to engage the reclosable lock.

According to another aspect, the disclosure is generally directed to a blank for forming a carton for holding at least one food product. The blank comprising a plurality of panels comprising a bottom panel, a first side panel foldably connected to the bottom panel, a second side panel foldably connected to the bottom panel, and at least one end panel foldably connected to the bottom panel. The blank comprises a plurality of flaps respectively foldably connected to the plurality of panels for closing the top of the carton formed from the blank. The plurality of flaps comprises a first side flap foldably connected to the first side panel and a second side flap foldably connected to the second side panel. The blank comprises locking features forming a reclosable lock for securing at least the first side flap and the second side flap to close the top of the carton formed from the blank. The locking features comprise a first locking feature and a second locking feature in the first side flap, and a first locking tab and a second locking tab in the second side flap. The first locking tab is for engagement with the first locking feature and the second locking tab is for engagement with the second locking feature to engage the reclosable lock in the carton formed from the blank.

According to another aspect, the disclosure is generally directed to a method of forming a carton for holding at least one food product. The method comprising obtaining a blank comprising a plurality of panels comprising a bottom panel, a first side panel foldably connected to the bottom panel, a second side panel foldably connected to the bottom panel, at least one end panel foldably connected to the bottom panel, and a plurality of flaps respectively foldably connected to the plurality of panels. The plurality of flaps comprises a first side flap foldably connected to the first side panel and a second side flap foldably connected to the second side panel. The blank comprises locking features comprising a first locking feature and a second locking feature in the first side flap and a first locking tab and a second locking tab in the second side flap. The method comprises at least partially forming an interior of the carton by positioning the plurality of panels, at least partially closing the top of the carton by positioning the first side flap and the second side flap, forming a reclosable lock from the locking features and securing at least the first side flap and the second side flap to close the top of the carton, and engaging the reclosable lock by engaging the first locking tab with the first locking feature and engaging the second locking tab with the second locking feature.

Other aspects, features, and details of the present disclosure can be more completely understood by reference to the following detailed description, taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The carton of the present disclosure can be useful in containing a food product such as any suitable type of food product that can be wrapped or sealed and stacked or placed on display. For example, the food product could include meats, deli foods, cooked food, or raw/uncooked food products. Some suitable food products could comprise sliced meat or cheese, raw meat, or any other suitable food or nonfood product. Further, the carton of the present disclosure can be used for color coding, providing brand and product information, and providing value-added features such as recipes and coupons. It is understood that products other than the food products listed herein may be contained in the carton. Further, food products contained in this carton may be generally triangular, round, square, rectangular, irregular, amorphous, or any other shape. In this specification, the terms "lower," "bottom," "upper," and "top" indicate orientations determined in relation to fully erected and upright cartons.

Figure 1:
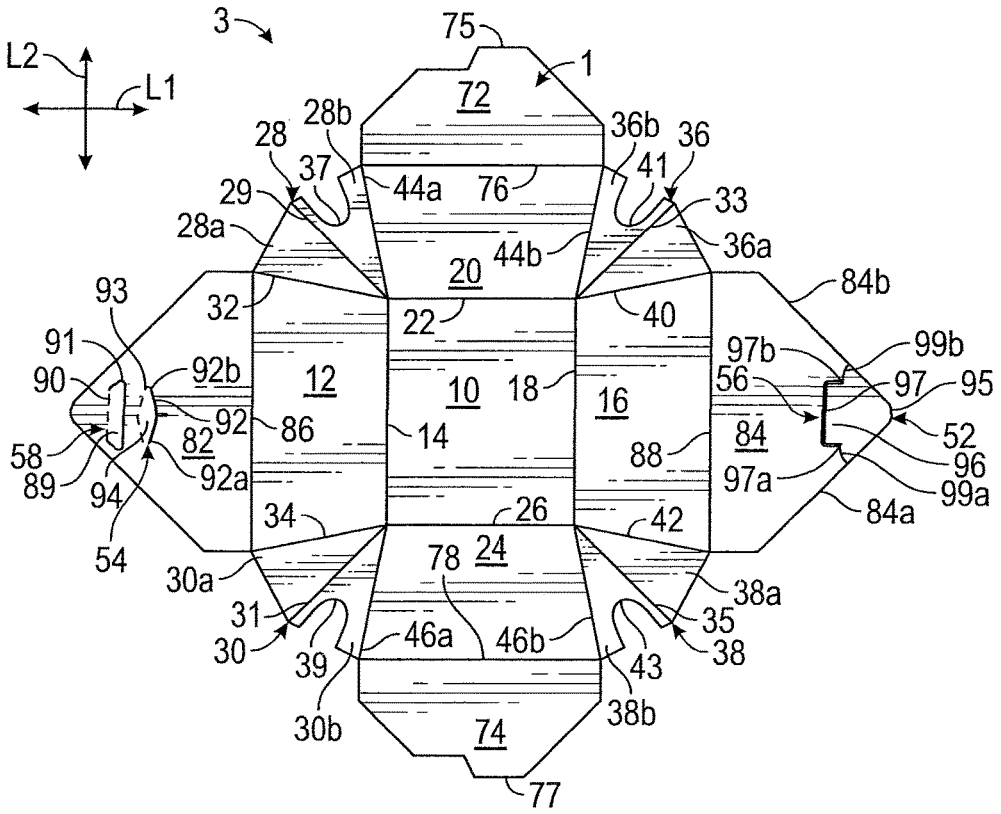
FIG. 1 is a plan view of the interior surface of a blank for forming a carton according to one exemplary embodiment of the disclosure.

FIG. 1 is a plan view of an exterior side 1 of a carton blank, generally indicated at 3, used to form a carton 5 (FIGS. 2-9) with an interior 7, according to a first exemplary embodiment of the disclosure. The carton 5 can be used to hold a food product (not shown). In the illustrated embodiment, the carton 5 is generally rectangular-shaped and can be suitable for holding a food product of any shape (e.g., vegetables, fruit, sliced deli meats or cheeses, ground beef, chicken cutlets, etc.) in a suitable manner for purchase at a grocery store or other retailer, but the carton could be otherwise shaped with the same or a different number of side panels to hold correspondingly shaped food products. Further, the carton 5 and blank 3 may be alternatively sized, shaped and/or otherwise arranged to hold any number of food products including a single food product or more than two food products. In one embodiment, the carton 5 is useful for holding the food product during storage in a refrigerator, a freezer, on display on shelves or in a deli case, during heating and/or cooking, during serving or consumption of the food product, and/or as a to go container for leftover food product after consumption. The carton 5 has locking features that include a primary lock 112 and a secondary lock 114 that lock top end flaps of the carton in a closed position, as described further herein, and can be releasably engaged to open the carton and allow access to the contents in the interior 7 of the carton.

As shown in FIG. 1, the carton blank 3 has a longitudinal axis L1 and a lateral axis L2. In the illustrated embodiment, the carton blank 3 comprises a bottom panel 10 foldably connected to a first side panel 12 at a longitudinal first fold line 14. A second side panel 16 is foldably connected to the bottom panel 10 at a longitudinal second fold line 18. A first end panel 20 is foldably connected to the bottom panel 10 at a lateral third fold line 22, and a second end panel 24 is foldably connected to the bottom panel 10 at a lateral fourth fold line 26. The blank 3 includes gussets 28, 30 respectively foldably connected to the first side panel 12 at fold lines 32, 34 located at respective ends of the first side panel 12. Gussets 36, 38 are respectively foldably connected to the second side panel 16 at fold lines 40, 42 located at respective ends of the second side panel 16. The gussets 28, 36 are respectively foldably connected to the first end panel 20 at fold lines 44*a*, 44*b* and the gussets 30, 38 are respectively foldably connected to the second end panel 24 at fold lines 46*a*, 46*b*.

Figure 2:
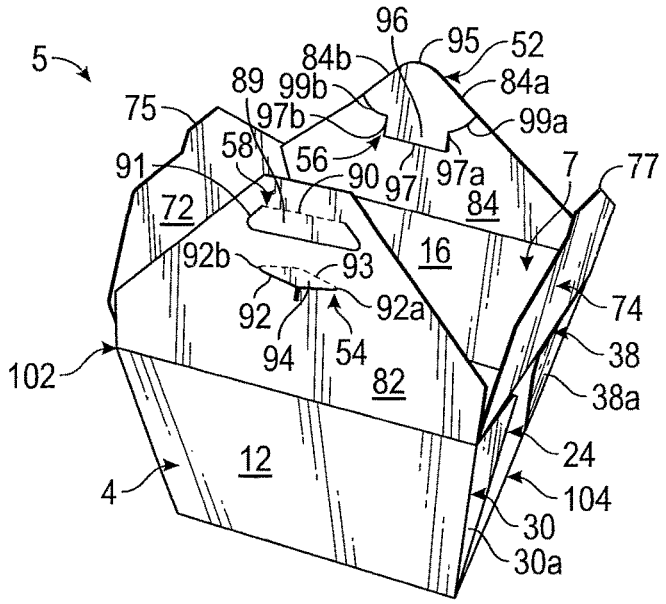
FIG. 2 is a perspective view of a carton formed from the blank of FIG. 1 in an open configuration.
Figure 3:
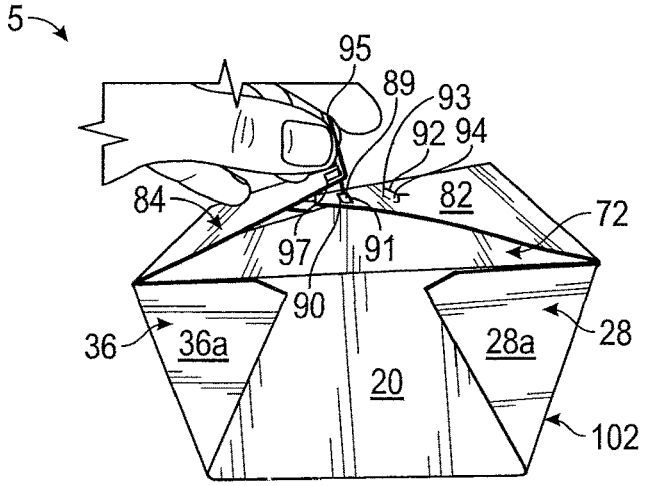
FIG. 3 is a first perspective sequential view of a closing and locking operation of the carton of FIG. 2.

Still referring to FIGS. 1 and 2, each of the gussets 28, 30, 36, 38 comprise a respective first gusset panel 28*a*, 30*a*, 36*a*, 38*a* foldably connected to a respective second gusset panel 28*b*, 30*b*, 36*b*, 38*b* along a respective fold line 29, 31, 33, 35. The second gusset panels 28*b* and 36*b* are foldably connected to the first side panel 20 and the second gusset panels 30*b* and 38*b* are foldably connected to the second side panel 24. In one embodiment, the second gusset panels 28*b*, 30*b*, 36*b*, 38*b* include a respective notch 37, 39, 41, 43. When the blank 3 is formed into the carton 5 (FIG. 2), the respective first and second gusset panels 28*a*, 30*a*, 36*a*, 38*a* and 28*b*, 30*b*, 36*b*, 38*b* of respective gussets 28, 30, 36, 38 may be overlapped such that notches 37, 39, 41, 43 provide a discontinuity through which the first gusset panels 28*a*, 30*a*, 36*a*, 38*a* of the gussets 28, 30, 36, 38 are adhered to the respective end panels 20, 24 on an exterior surface 4 of the carton 5, as described further herein.

In the illustrated embodiment, each of the first and second end panels 20, 24 include a respective end flap 72, 74 foldably connected to one of the first and second end panels 20, 24 at a respective lateral fold line 76, 78. The end flaps 72, 74 may include a respective extension 75, 77 extending outwardly from the edge of the respective end flaps 72, 74. The blank 3 could be otherwise shaped, arranged, and/or configured without departing from the disclosure. For example, the notches 37, 39, 41, 43 or the extension flaps 75, 77 could be omitted without departing from the scope of this disclosure.

In one embodiment, each of the first and second side panels 12, 16 can include a respective side flap 82, 84 foldably connected to one of the first and second side panels 12, 16 at a respective longitudinal fold line 86, 88. The first side flap 82 also includes a retention flap 94 (broadly "first locking flap") formed by a cut 92 having a generally "Y" shape and an arcuate fold line 93 extending between the ends 92*a*, 92*b* of the cut 92 (best shown in FIG. 9). The side flap 82 includes a second locking flap 89 defined by a cut 91 and the first locking flap 89 is foldably connected to the side flap 82 along fold line 90. In alternative embodiments, one or both of the first locking flap 94 and the second locking flap 89 may be devoid of an associated fold line. The side flap 84 also includes a first locking tab 96 defined by cut 97 and arcuate fold lines 99*a*, 99*b* that extend from the ends 97*a*, 97*b* of the cut 97 to the outer edges 84*a*, 84*b*. In one embodiment, the second side flap 84 includes oblique side edges 84*a*, 84*b* that converge to a rounded corner or second locking tab 95.

As described herein, a first locking tab 52 in the second side flap 84 includes at least the tab 95 and a first locking feature 54 in the first side flap 82 includes the retention flap 94, formed by the cut 92 and the fold line 93. A second locking tab 56 in the second side flap 84 includes the locking tab 96 formed by the cut 97 and the arcuate fold lines 99*a*, 99*b*, and a second locking feature 58 in the first side flap 82 includes the locking flap 89 formed by the cut 91 and the fold line 90.

Figure 4:
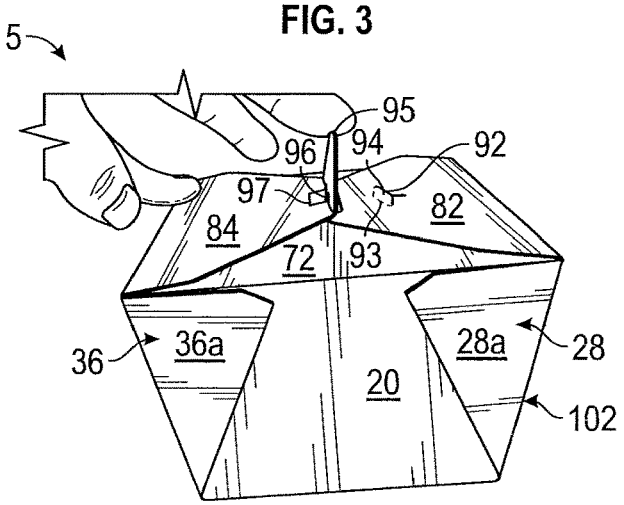
FIG. 4 is a second perspective sequential view of a closing and locking operation of the carton of FIG. 2.
Figure 5:
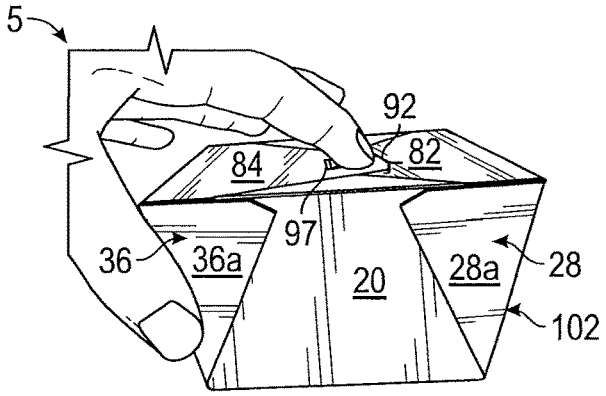
FIG. 5 is a third perspective sequential view of a closing and locking operation of the carton of FIG. 2.
Figure 6:
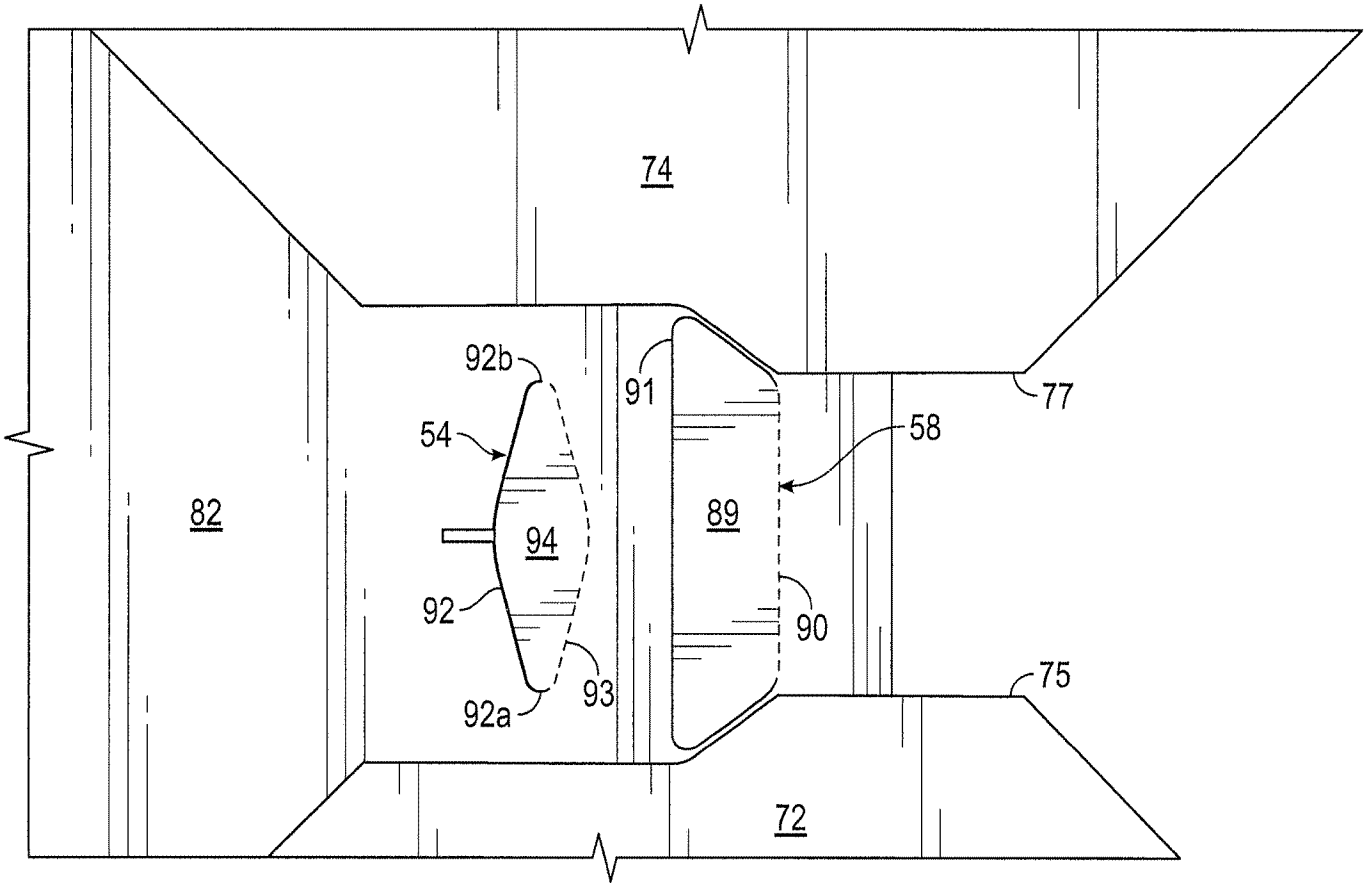
FIG. 6 is an enlarged plan view of a portion of the interior of the carton of FIG. 3.
Figure 7:
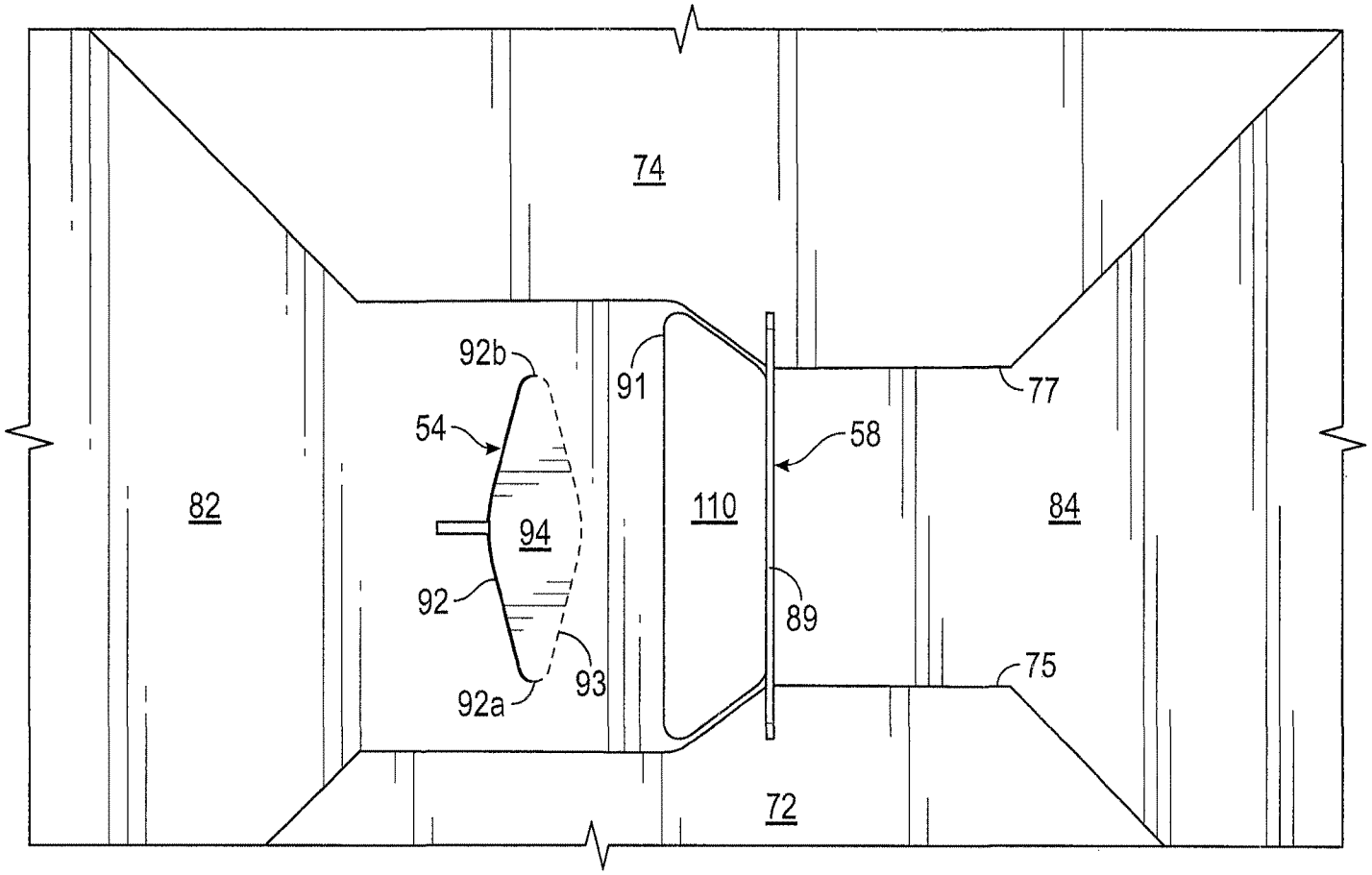
FIG. 7 is an enlarged plan view of a portion of the interior of the carton of FIG. 4.
Figure 8:
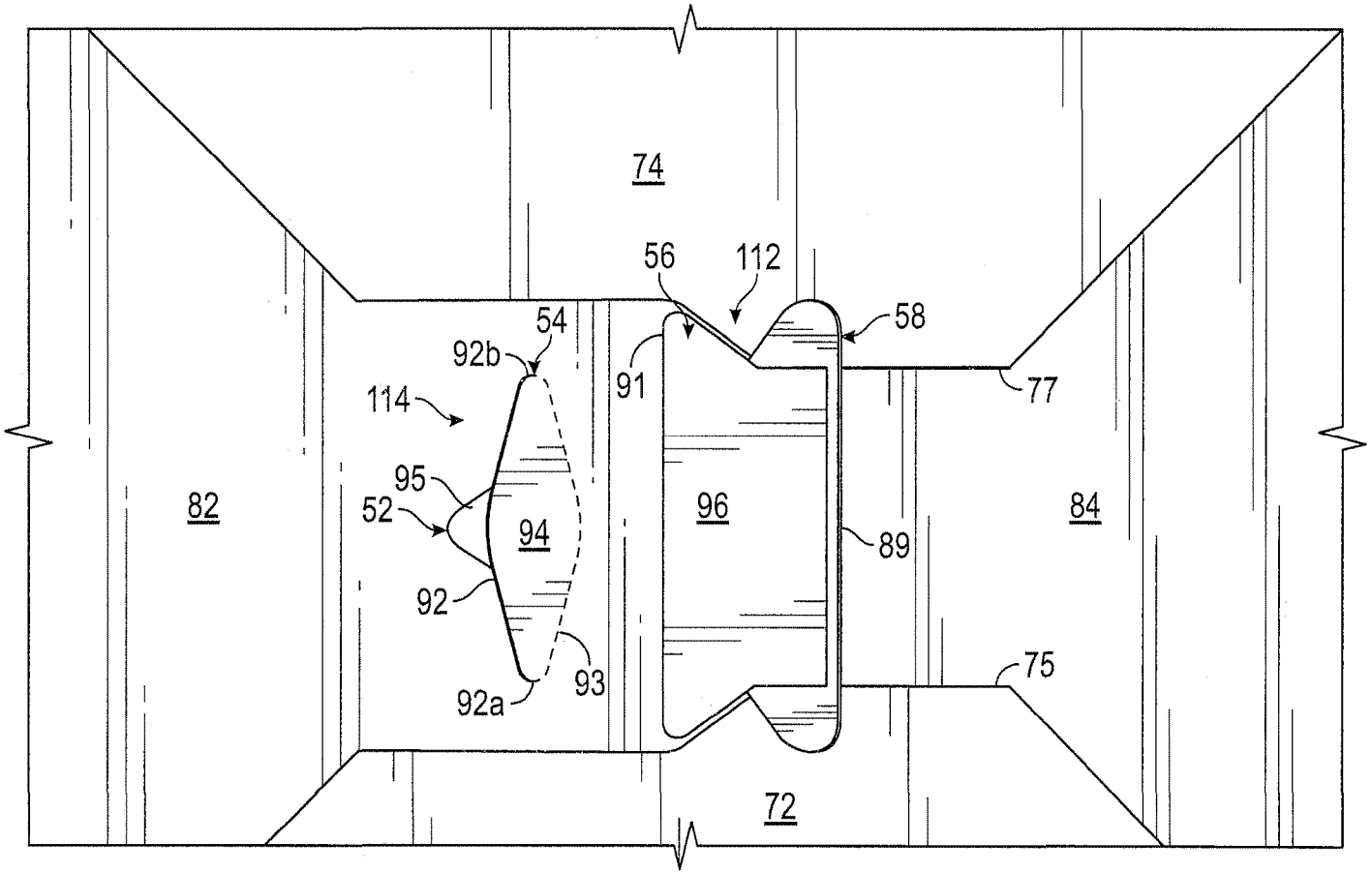
FIG. 8 is an enlarged plan view of a portion of the interior of the carton of FIG. 5.
Figure 9:
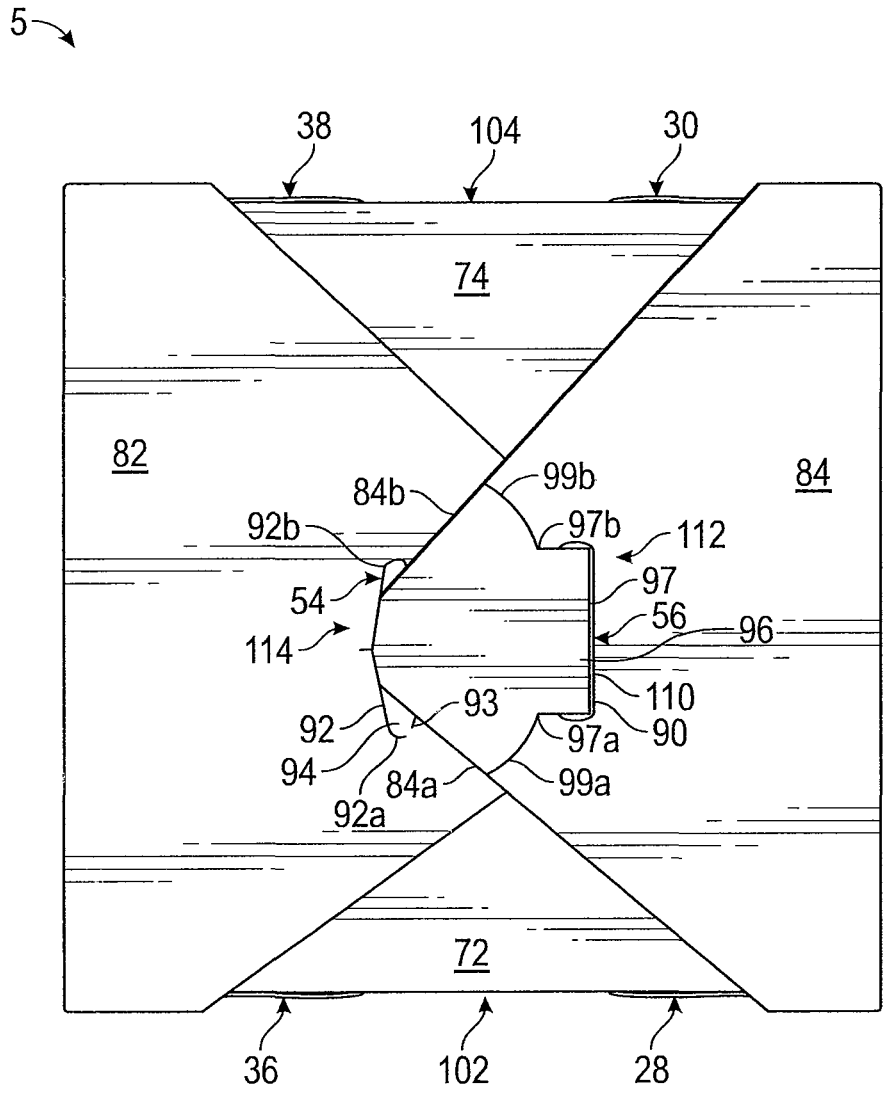
FIG. 9 is a plan view of the exterior of the carton of FIG. 5 in a closed and locked configuration.

Still referring to FIGS. 1 and 2, the blank 3 is formed into the carton 5 with an interior 7 by folding the first and second side panels 12, 16 and the first and second end panels 20, 24 relative to the bottom panel 10 along respective fold lines 14, 18, 22, 26. The gussets 28, 36 are folded along the respective fold lines 29, 33 and adhered in face-to-face contact with an exterior surface 4 of the carton 5 along the first end panel 20. The gusset panels 30*a*, 30*b* and 38*a*, 38*b* of the respective gussets 30, 38 are folded along the respective fold lines 31, 35 and adhered in face-to-face contact with the exterior surface 4 of the carton 5 along the second end panel 24. Accordingly, the erected gussets 28, 36, 30, 38 in face-to-face contact with the respective end panels 20, 24 to form ends 102, 104 of the carton 5. The ends 102, 104 of the carton 5 can be alternatively, shaped, arranged, and/or configured without departing from the disclosure. For example, the gussets 28, 36, 30, 38 could be in face-to-face contact with the interior surfaces of the respective end panels 20, 24, or may be folded into contact with the side panels 12, 16. As shown in FIG. 4, the carton 5 has an open top with sides 12, 16 and closed ends 102, 104 prior to closure of the end flaps 72, 74 and the side flaps 82, 84, as described further herein.

Still referring to FIG. 1, and as shown in FIGS. 3-5 and 6-8, the top of the carton 5 is closed by folding the end flaps 72, 74 relative to the end panels 20, 24 along respective fold lines 76, 78 and folding the side flaps 82, 84 relative to the side panels 12, 16 along respective fold lines 86, 88 to at least partially overlap the end flaps 72, 74.

As shown, the locking flap 89 can be folded inwardly toward the interior 7 of the carton 5 along fold line 90 to form an opening 110 with the locking flap 89 at least partially overlapping the extension flaps 75, 77 to hold the side flaps 72, 74 in face-to-face contact with at least one of the first and second end flaps 82, 84. The locking tab 96 may be formed by folding the corner of flap 84 such that the locking tab 96 is partially separated from the remainder of flap 84 and at least partially folded along fold lines 99*a*, 99*b* so that the locking tab 96 projects toward the interior 7 of the carton 5. In this regard, the locking tab 96 projects in a direction opposite the tab 95. The carton 5 can be held in the closed configuration by inserting the locking tab 96 into engagement with the locking flap 89 to form the opening 110 to engage the locking flap 89 and form the primary lock 112. The locking tab 96 is attached to the remainder of side flap 84 such that a biasing force is exerted upwardly upon the locking flap 89 and side flaps 72, 74 to facilitate and maintain closure of the carton 5. For example, fold lines 99*a*, 99*b* are configured such that locking flap 96 is biased to return toward planar alignment with the remainder of flap 84. The inward folding of the flap 89 to form the opening 110 may be initiated by inserting the locking tab 96 into engagement with the flap 89. In other embodiments, the opening 110 may be formed by manual engagement of the flap 89 by a user prior to insertion of the locking tab 96.

In one embodiment, he secondary lock 114 may be formed by inserting the tab 95 through the cut 92 such that the retention flap 94 (broadly the "first locking flap") is in face-to-face contact with the locking tab 95 and applies an upward biasing force on the tab 95 to further facilitate and maintain closure of the carton 5. In this regard, the retention flap 94 may be disposed in overlapping face-to-face contact with the tab 95 upon insertion of the tab into the cut 92 so that at least a portion of the locking tab 95 extends past the cut to engage the side flap 82 and form the secondary lock 114.

In one embodiment, in this regard, the primary lock 112 engages all four flaps 72, 74, 82, and 84 to inhibit or prevent disengagement of the first and second side flaps 82, 84 and end flaps 20, 24 from one another. The secondary lock 114 comprises the tab 95 inserted through the cut 92 and the retention flap 94 applying a biasing force to the tab 95 to inhibit or prevent the tab 95 from unintentional disengagement from the cut 92. Accordingly, the secondary lock 114 further inhibits or prevents disengagement of the first and second side flaps 82, 84 and end flaps 20, 24 from one another along a different location from primary lock 112.

In one embodiment, the carton 5 can be opened by disengaging the secondary lock 114 by withdrawing the tab 95 from the cut 92. The carton 5 can be fully opened by disengaging the primary lock 112 by pivoting the first locking tab 95 to lifting the second end flap to withdraw the second locking tab 96 from the opening 110 to unlock the flaps 72, 74, 82 and 84 and allow the flap to fold to the open position of FIG. 2.

As shown, the primary lock 112 of the carton 5 engages all the flaps 72, 74, 82, 84 to secure the end flaps 72, 74, 82, 84 in a closed position of the carton 5 and the secondary lock 114 assists in maintaining the flaps 72, 74, 82, 84 in the closed position. The secondary lock 114 includes the first locking tab 52 (and locking tab 95) and the first locking feature 54 (including the cut 92 and first locking flap 94) and the primary lock 112 includes the second locking tab 56 (and second locking tab 96) and the second locking feature 58 (including the locking flap 89 and locking opening 110). In embodiments, carton 5 may be provided with features for closing and locking in a different configuration, for example, only one of primary lock 112 and secondary lock 114, or with the second locking tab 56 and second locking feature 58 serving as a secondary lock and the first locking tab 52 and first locking feature 54 serving as a primary lock.

In the illustrated embodiment, the side panels 12, 16 and the end panels 20, 24 of the assembled carton 5 are sloped with respect to the bottom panel 10 so that multiple cartons 5 can be stacked, for example, with each carton 5 nested in a carton 5 below.

One or more products, such as raw or prepared food products (not shown), can be inserted into the interior 7 of the carton 5. In one exemplary embodiment, the carton and product(s) can be wrapped in plastic or other material, sealing the product(s) in the carton to keep the product(s) fresh, to prevent contamination of the product(s), and/or to help prevent leaking of fluids. Additionally, an insert, a coating, an absorption pad, or other features can be applied to the carton to help control fluids and/or retain the product (s) in the carton.

Logos, brand information, product information, other printed material, or combinations thereof can be printed on any surface of the carton 5. In one embodiment, the coated exterior surface of the blank 3 that forms the exterior surface 4 of carton 5 provides ideal surfaces of the carton 5 for printing graphics or other indicia. In the illustrated embodiment, the carton 5 can include tear-away panels (not shown) or other features for including coupons, recipes, or other value-added features. In one exemplary embodiment, the carton 5 comprises paperboard and provides a collapsible, crushable, and degradable carton for helping to reduce the volume and duration of waste. Additionally, the paperboard can be recyclable.

Any of the various embodiments of the present disclosure generally could include at least one microwave energy interactive element that may comprise a susceptor for becoming hot when exposed to microwave energy, although other types and various combinations of microwave energy interactive elements are also within the scope of the present disclosure. Also, the various embodiments of the present disclosure could be free of a microwave energy interactive element without departing from the disclosure.

A blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, and alterations, etc., of the above-described embodiments that are within the scope of the claims. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one food product, the carton comprising:

a plurality of panels that extends at least partially around an interior of the carton, the plurality of panels comprising a bottom panel, a first side panel foldably connected to the bottom panel, a second side panel foldably connected to the bottom panel, and at least one end panel foldably connected to the bottom panel;

a plurality of flaps respectively foldably connected to the plurality of panels for closing a top of the carton, the plurality of flaps comprises a first side flap foldably connected to the first side panel and a second side flap foldably connected to the second side panel;

a reclosable lock for securing at least the first side flap and the second side flap to close the top of the carton, the reclosable lock comprises a first locking feature and a second locking feature in the first side flap, and a first locking tab and a second locking tab in the second side flap, the first locking tab being for engagement with the first locking feature and the second locking tab being for engagement with the second locking feature to engage the reclosable lock.

2. The carton of claim 1, wherein the first locking tab and the first locking feature form a secondary lock and the second locking tab and the second locking feature form a primary lock.

3. The carton of claim 2, wherein the second locking tab is at least partially defined by a cut and at least one fold line and is pivotable relative to the second side flap.

4. The carton of claim 3, wherein the first locking feature comprises a first locking flap and the second locking feature comprises a second locking flap.

5. The carton of claim 4, wherein the first locking flap is defined by a cut and forms a first locking opening, the second locking flap is foldably connected to the first side flap and pivotable relative to the first side flap to form a second locking opening.

6. The carton of claim 5, wherein the second locking tab is in engagement with the second locking opening to engage the primary lock.

7. The carton of claim 6, wherein the first locking tab is in engagement with the first locking opening to engage the secondary lock.

8. The carton of claim 6, wherein the plurality of flaps comprises at least one end flap foldably connected to the at least one end panel, the primary lock engages at least a portion of the at least one end flap.

9. The carton of claim 8, wherein the second locking tab is in face-to-face contact with the second locking flap and the second locking flap is in face-to-face contact with at least a portion of the at least one end flap.

10. The carton of claim 9, wherein the at least one end panel is a first end panel, the at least one end flap is a first end flap, the plurality of panels comprises a second end panel and the plurality of end flaps comprises a second end flap foldably connected to the second end panel.

11. The carton of claim 10, wherein the primary lock engages at least one of the first end flap and the second end flap.

12. The carton of claim 11, wherein the second locking flap is in face-to-face contact with at least a portion of at least one of the first end flap and the second end flap.

13. The carton of claim 8, wherein the at least one end flap comprises an extension, the primary lock engages at least a portion of the extension.

14. The carton of claim 6, wherein the first locking tab is in engagement with the first locking opening to engage the secondary lock.

15. The carton of claim 14, wherein the first locking tab is in face-to-face contact with the first locking flap.

16. The carton of claim 15, wherein the first locking tab comprises at least one edge of the second side flap.

17. The carton of claim 16, wherein the at least one edge comprises a pair of oblique edges that converge to form the first tab.

18. The carton of claim 1, wherein the first side panel, the second side panel, and the at least one end panel are sloped relative to the bottom panel.

19. The carton of claim 1, wherein a first gusset foldably connects the first side panel and the at least one end panel and a second gusset foldably connects the second side panel and the at least one end panel.

20. The carton of claim 19, wherein each of the first gusset and the second gusset comprises a first gusset panel and a second gusset panel foldably connected at a fold line, the second gusset panel comprises a notch in an edge of the gusset.

21. The carton of claim 20, wherein the first gusset panel of each of the first gusset and the second gusset is attached to an exterior surface of the at least one end panel through the notch.

22. A blank for forming a carton for holding at least one food product, the blank comprising:

a plurality of panels comprising a bottom panel, a first side panel foldably connected to the bottom panel, a second side panel foldably connected to the bottom panel, and at least one end panel foldably connected to the bottom panel;

a plurality of flaps respectively foldably connected to the plurality of panels for closing a top of the carton formed from the blank, the plurality of flaps comprises a first side flap foldably connected to the first side panel and a second side flap foldably connected to the second side panel; and locking features forming a reclosable lock for securing at least the first side flap and the second side flap to close the top of the carton formed from the blank, the locking features comprise a first locking feature and a second locking feature in the first side flap, and a first locking tab and a second locking tab in the second side flap, the first locking tab being for engagement with the first locking feature and the second locking tab being for engagement with the second locking feature to engage the reclosable lock in the carton formed from the blank.

23. The blank of claim 22, wherein the first locking tab and the first locking feature form a secondary lock in the carton formed from the blank and the second locking tab and the second locking feature form a primary lock in the carton formed from the blank.

24. The blank of claim 23, wherein the second locking tab is at least partially defined by a cut and at least one fold line and is pivotable relative to the second side flap, the first locking feature comprises a first locking flap and the second locking feature comprises a second locking flap.

25. The blank of claim 24, wherein the first locking flap is defined by a cut and forms a first locking opening, the second locking flap is foldably connected to the first side flap and pivotable relative to the first side flap to form a second locking opening.

26. The blank of claim 25, wherein the plurality of flaps comprises at least one end flap foldably connected to the at least one end panel, the primary lock engages at least a portion of the at least one end flap in the carton formed from the blank.

27. The blank of claim 26, wherein the second locking tab is in face-to-face contact with the second locking flap in the carton formed from the blank and the second locking flap is in face-to-face contact with at least a portion of the at least one end flap in the carton formed from the blank.

28. The blank of claim 27, wherein the at least one end panel is a first end panel, the at least one end flap is a first end flap, the plurality of panels comprises a second end panel and the plurality of end flaps comprises a second end flap foldably connected to the second end panel, the primary lock engages at least one of the first end flap and the second end flap in the carton formed from the blank and the second locking flap is in face-to-face contact with at least a portion of at least one of the first end flap and the second end flap in the carton formed from the blank.

29. The blank of claim 26, wherein the at least one end flap comprises an extension, the primary lock engages at least a portion of the extension in the carton formed from the blank.

30. The blank of claim 25, wherein the first locking tab is in engagement with the first locking opening to engage the secondary lock and is in face-to-face contact with the first locking flap in the carton formed from the blank.

31. The blank of claim 30, wherein the first locking tab comprises at least one edge of the second side flap.

32. The blank of claim 31, wherein the at least one edge comprises a pair of oblique edges that converge to form the first tab.

33. The blank of claim 22, wherein a first gusset foldably connects the first side panel and the at least one end panel and a second gusset foldably connects the second side panel and the at least one end panel.

34. The blank of claim 33, wherein each of the first gusset and the second gusset comprises a first gusset panel and a second gusset panel foldably connected at a fold line, the second gusset panel comprises a notch in an edge of the gusset.

35. The blank of claim 34, wherein the first gusset panel of each of the first gusset and the second gusset is attached to an exterior surface of the at least one end panel through the notch in the carton formed from the blank.

36. A method of forming a carton for holding at least one food product, the method comprising:

obtaining a blank comprising a plurality of panels comprising a bottom panel, a first side panel foldably connected to the bottom panel, a second side panel foldably connected to the bottom panel, and at least one end panel foldably connected to the bottom panel, a plurality of flaps respectively foldably connected to the plurality of panels, the plurality of flaps comprises a first side flap foldably connected to the first side panel and a second side flap foldably connected to the second side panel, locking features comprising a first locking feature and a second locking feature in the first side flap and a first locking tab and a second locking tab in the second side flap, at least partially forming an interior of the carton by positioning the plurality of panels;

at least partially closing a top of the carton by positioning the first side flap and the second side flap;

forming a reclosable lock from the locking features and securing at least the first side flap and the second side flap to close the top of the carton; and engaging the reclosable lock by engaging the first locking tab with the first locking feature and engaging the second locking tab with the second locking feature.

37. The method of claim 36, wherein the forming the reclosable lock comprises forming a secondary lock comprising the first locking tab and the first locking feature and a primary lock comprising the second locking tab and the second locking feature.

38. The method of claim 37, wherein the second locking tab is at least partially defined by a cut and at least one fold line, the first locking feature comprises a first locking flap and the second locking feature comprises a second locking flap.

39. The method of claim 38, wherein the first locking flap is defined by a cut and forms a first locking opening, and the engaging the reclosable lock comprises pivoting the second locking tab to engage and pivot the second locking flap to form a second locking opening and engage the primary lock.

40. The method of claim 39, further comprising engaging the secondary lock by engaging the first locking tab with the first locking opening.

41. The method of claim 40, wherein the engaging the secondary lock comprises engaging the first locking tab with the first locking opening and positioning the first locking tab in face-to-face contact with the first locking flap.

42. The method of claim 39, wherein the plurality of flaps comprises at least one end flap foldably connected to the at least one end panel, the primary lock engages at least a portion of the at least one end flap.

43. The method of claim 42, wherein the engaging the primary lock comprises positioning the second locking tab in face-to-face contact with at least a portion of the second locking flap and positioning the second locking flap in face-to-face contact with at least a portion of the at least one end flap.

44. The method of claim 43, wherein the at least one end panel is a first end panel, the at least one end flap is a first end flap, the plurality of panels comprises a second end panel and the plurality of end flaps comprises a second end flap foldably connected to the second end panel, the engaging the primary lock comprises positioning the second locking flap in face-to-face contact with at least a portion of at least one of the first end flap and the second end flap.

45. The method of claim 42, wherein the at least one end flap comprises an extension, the primary lock engages at least a portion of the extension.

46. The method of claim 36, wherein the blank comprises a first gusset foldably connected the first side panel and the at least one end panel and a second gusset foldably connected to the second side panel and the at least one end panel.

47. The method of claim 46, wherein each of the first gusset and the second gusset comprises a first gusset panel and a second gusset panel foldably connected at a fold line, the second gusset panel comprises a notch in an edge of the gusset, the at least partially forming the interior of the carton comprises attaching the first gusset panel of each of the first gusset and the second gusset to an exterior surface of the at least one end panel through the notch.

* * * * *